US005592704A

United States Patent [19]

Breese

[11] Patent Number: 5,592,704

[45] Date of Patent: Jan. 14, 1997

[54] CRIB VENTILATING SYSTEM

[76] Inventor: Steven M. Breese, 4132 8th St., Des Moines, Iowa 50313

[21] Appl. No.: 514,494

[22] Filed: Aug. 11, 1995

[51] Int. Cl.[6] ..... A47C 21/04; A47D 15/00

[52] U.S. Cl. ..... 5/423; 5/93.1; 5/658

[58] Field of Search ..... 5/423, 284, 93.1, 5/658, 469, 910

[56] References Cited

U.S. PATENT DOCUMENTS

| | | | |
|---|---|---|---|
| 2,097,751 | 4/1937 | Baltich | 5/284 |
| 3,735,430 | 5/1973 | Platz | 5/93.1 |
| 3,878,570 | 4/1975 | Donnelly | 5/284 |
| 5,317,767 | 6/1994 | Hargest et al. | 5/423 |

FOREIGN PATENT DOCUMENTS

| | | | |
|---|---|---|---|
| 0491145 | 10/1991 | European Pat. Off. | 5/284 |
| 2641455 | 7/1990 | France | 5/423 |
| 2065465 | 7/1981 | United Kingdom | 5/283 |
| 2213388 | 8/1989 | United Kingdom | 5/284 |
| 8203163 | 9/1982 | WIPO | 5/423 |

*Primary Examiner*—Alexander Grosz

*Attorney, Agent, or Firm*—Zarley, McKee, Thomte, Voorhees, & Sease

[57] ABSTRACT

A device for blowing small volumes of air across a mattress in a crib to prevent the accumulation of undesirable gases includes a pump, blower or fan, an elongated conduit connected to the pump, blower or fan and positioned adjacent the top surface of the mattress. The conduit has a plurality of longitudinally spaced perforations therein so as to provide a plurality of directed air flows across the top surface of the mattress. The conduit can be rested on the top surface of the mattress, but can also be hung from a vertically adjustable side rail by a vertically extensible telescoping mounting bracket. Dual conduits can be connected to the pump, blower or fan in parallel and positioned at either side of the crib. A method for preventing the accumulation of carbon dioxide around a sleeping infant in a crib includes the steps of placing at least one air conduit having a plurality of perforations therein adjacent to top surface of the mattress, connecting a pump, blower or fan to the air conduit, and pumping the air through the perforations of the conduit so as to provide a plurality of air flows directed substantially horizontally across the top surface of the mattress to disperse carbon dioxide exhaled by the infant and ensure the continued normal breathing by the infant.

7 Claims, 3 Drawing Sheets

CRIB VENTILATING SYSTEM

BACKGROUND OF THE INVENTION

The present invention relates to the field of air circulatory devices for cribs. More particularly, this invention relates to a method and device for circulating air at mattress level in a crib so as to prevent the accumulation of carbon dioxide and other gases around a sleeping infant.

Various gases may be present at the mattress level of a baby crib. Some of these gases may cause unpleasant odors, some of these gases may also be harmful to a sleeping infant. Recently, some researchers have postulated that when the infant sleeps in certain positions, its own body and shallow breathing may create a pocket of carbon dioxide gas around the baby's head. The baby may then inhale this carbon dioxide and cease normal breathing, thus leading to the phenomenon known as Sudden Infant Death Syndrome or SIDS.

Portable and stationary fans are known to be useful in displacing air around an infant's crib. However, fans tend to displace relatively large volumes of air and thereby cause undesirable drafts on the infant. Also, fans tend to consume a great deal of energy and achieve gross circulation of air within a room rather than specifically preventing pockets of gases from forming around an infant at the mattress level of a crib. There is a need for a device and method for circulating relatively small volumes of air in a predetermined pattern across the crib at mattress level.

Fans can also be a hazardous addition to the environment of the infant. The small fingers of the infant may find a way to come into contact with the fan blades. Furthermore, fans often come equipped with electrical cords that can be pulled by the infant, causing the fan to fall on them. The cords can also present strangulation and electrocution hazards.

Therefore, a primary objective of the present invention is the provision of a device and method for circulating air at mattress level in a crib so as to prevent the accumulation of various undesirable gases around a sleeping infant.

Another objective of the present invention is the provision of a device that is mountable on the mattress or the side rails of a crib.

A further objective of the present invention is a provision of a device which is mountable to the side rail of a crib in such a manner that said side rail can still be raised and lowered with respect to the mattress.

A further objective of the present invention is a provision of a device that is simple in construction and is quick and easy to install.

A further objective of the present invention is a provision of a method of circulating air at mattress level in a crib so as to prevent or at least to reduce the likelihood of an infant's death from SIDS.

A further objective of the present invention is a provision of a device that lacks exposed moving parts such that it is a safe addition to the environment of the infant.

A further objective of the present invention is a provision of a air circulation device that does not produce a draft perceptible to the infant or its caregiver.

A further objective of the present invention is a provision of a device that is economical to manufacture and durable and safe in use.

These and other objectives will become apparent to one skilled in the art in view of the following description.

SUMMARY OF THE INVENTION

The present invention includes a device for blowing small volumes of air across a mattress in a crib to prevent the accumulation of undesirable gases. The device includes a pump, blower or fan and a pair of elongated conduits connected to the pump, blower or fan and positioned adjacent the top surface of the mattress on each side of the crib. The conduits have a plurality of longitudinally spaced perforations therein so as to provide a plurality of horizontally directed air flows across the top surface of the mattress. The conduits can be rested on the top surface of the mattress, but can also be hung from a vertically adjustable side rail of the crib by telescoping mounting brackets that are vertically extensible. While a single conduit may be used, a pair of perforated conduits mounted opposite each other in the crib provides better air circulation on both sides of the infant.

A method for preventing the accumulation of carbon dioxide around an infant lying in a crib includes the steps of providing at least one air conduit having a plurality of perforations therein, placing the air conduit in the crib adjacent the top surface of the mattress, connecting a pump, blower or fan to the air conduit, and pumping the air through the perforations of the conduit so as to provide a plurality of air flows directed across the top surface of the mattress to disperse carbon dioxide exhaled by the infant and ensure continued normal breathing.

DETAILED DESCRIPTION OF THE PREFERRED EMBODIMENT

Figure 1:
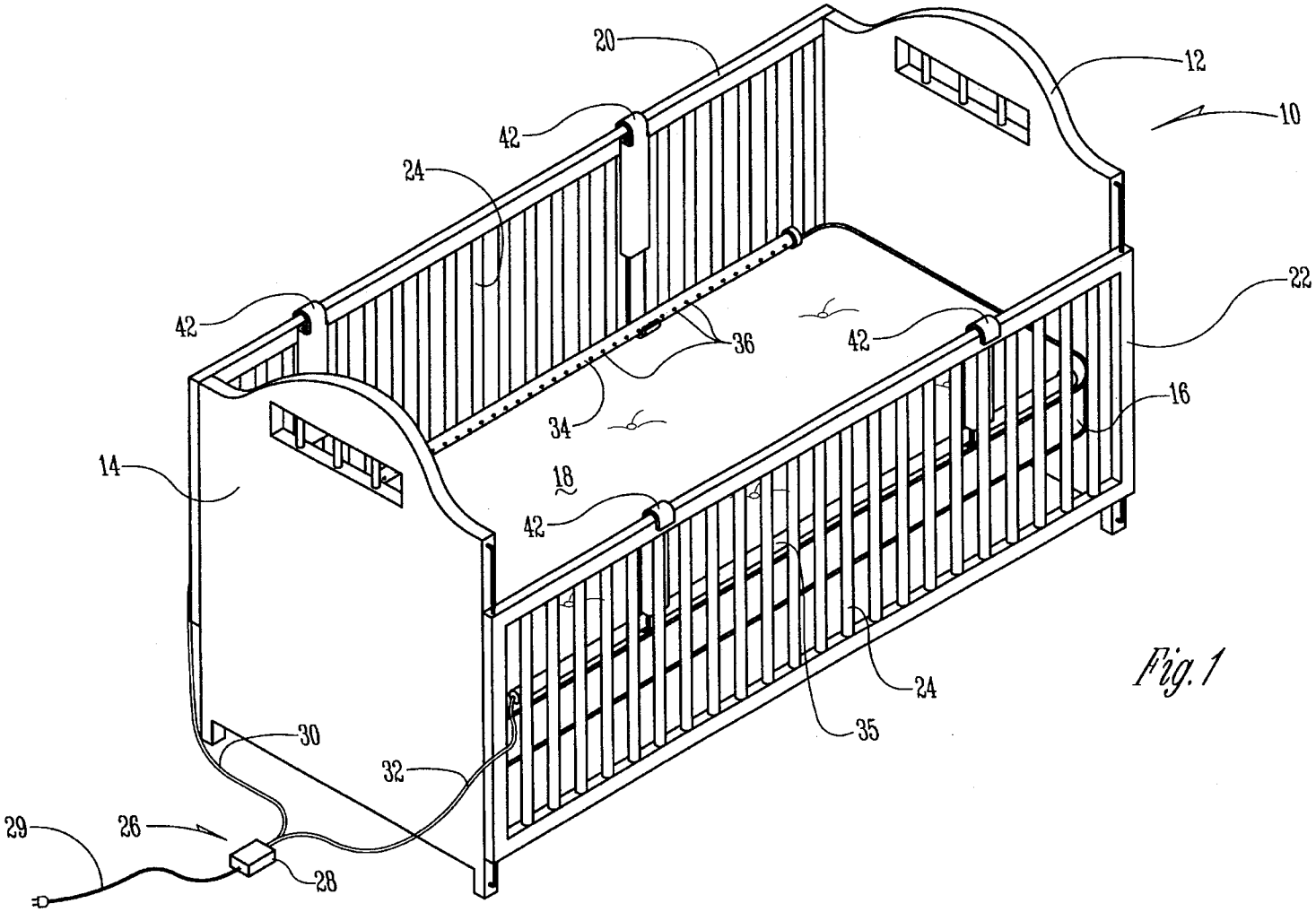
FIG. 1 is a perspective view of a crib equipped with the air circulation device of the present invention.

Young infants typically sleep in a conventional crib 10 having a headboard 12 at one end and a footboard 14 at the other end, as shown in FIG. 1. The crib 10 includes a mattress 16 conventionally mounted between the headboard 12 and the footboard 14. The mattress 16 has a top surface 18 on which an infant can be laid to sleep. The headboard 12 and the footboard 14 also conventionally support side rails 20 and 22 and form an assembly that is collectively referred to hereinafter as the frame of the crib 10. The frame of the crib 10 supports the mattress 16 and constrains it against lateral movement.

As is known in the art, side rails 20 and 22 have a plurality of vertical bars 24 which are spaced closely enough together to prevent the infant from accidentally falling out of the crib 10 through the bars 24. At least one of the side rails 20 and 22 is vertically adjustable with respect to the headboard 12, the footboard 14, and the top surface 18 of the mattress 16. In FIG. 1, the side rail 22 is shown to be vertically adjustable. This feature allows the caregiver to lower the side rail 22 to pick the baby up or lay it down. The vertically adjustable side rail 22 can be raised and locked in place after placing the infant in the crib 10.

The crib 10 as described above, is conventional and does not constitute a part of the present invention.

The present invention is directed towards a low volume air blowing device 26 for the crib 10. The device 26 includes an electrically powered air pump, blower or fan 28, hoses 30, 32 and a pair of conduits 34, 35. The pump, blower or fan 28 includes an electrical cord and plug 29 for plugging into a conventional household electrical outlet. The pump, blower or fan 28 is similar in size and construction to those used in household aquariums. In the preferred embodiment, the air pump, blower or fan 28 has an output capacity of approximately 20–25 cfm. The pump, blower or fan 28 is connected in parallel to dual output hoses 30 and 32.

Figure 2:
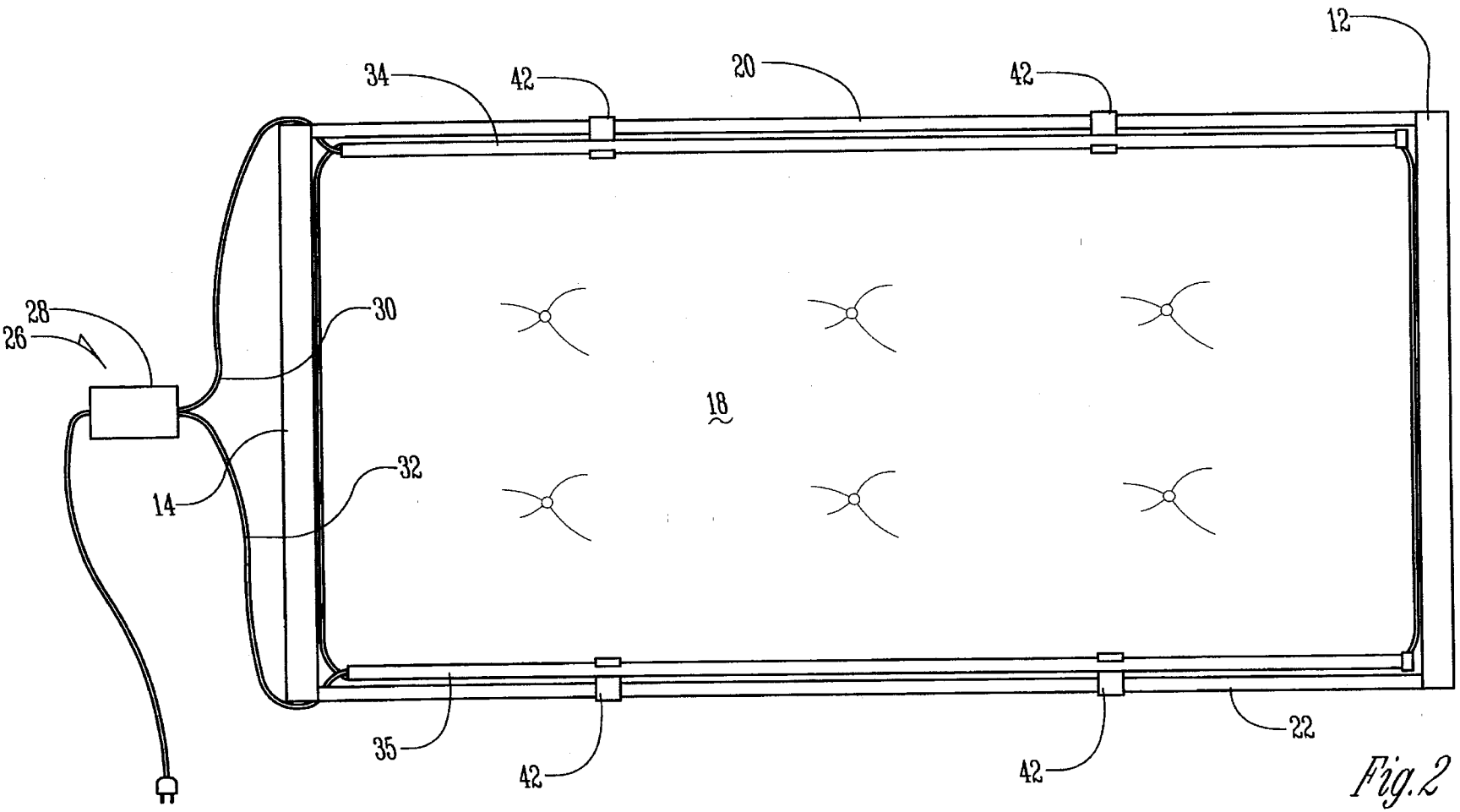
FIG. 2 is a top plan view of the crib of FIG. 1 equipped with the air circulation device of the present invention.
Figures 3, 4:
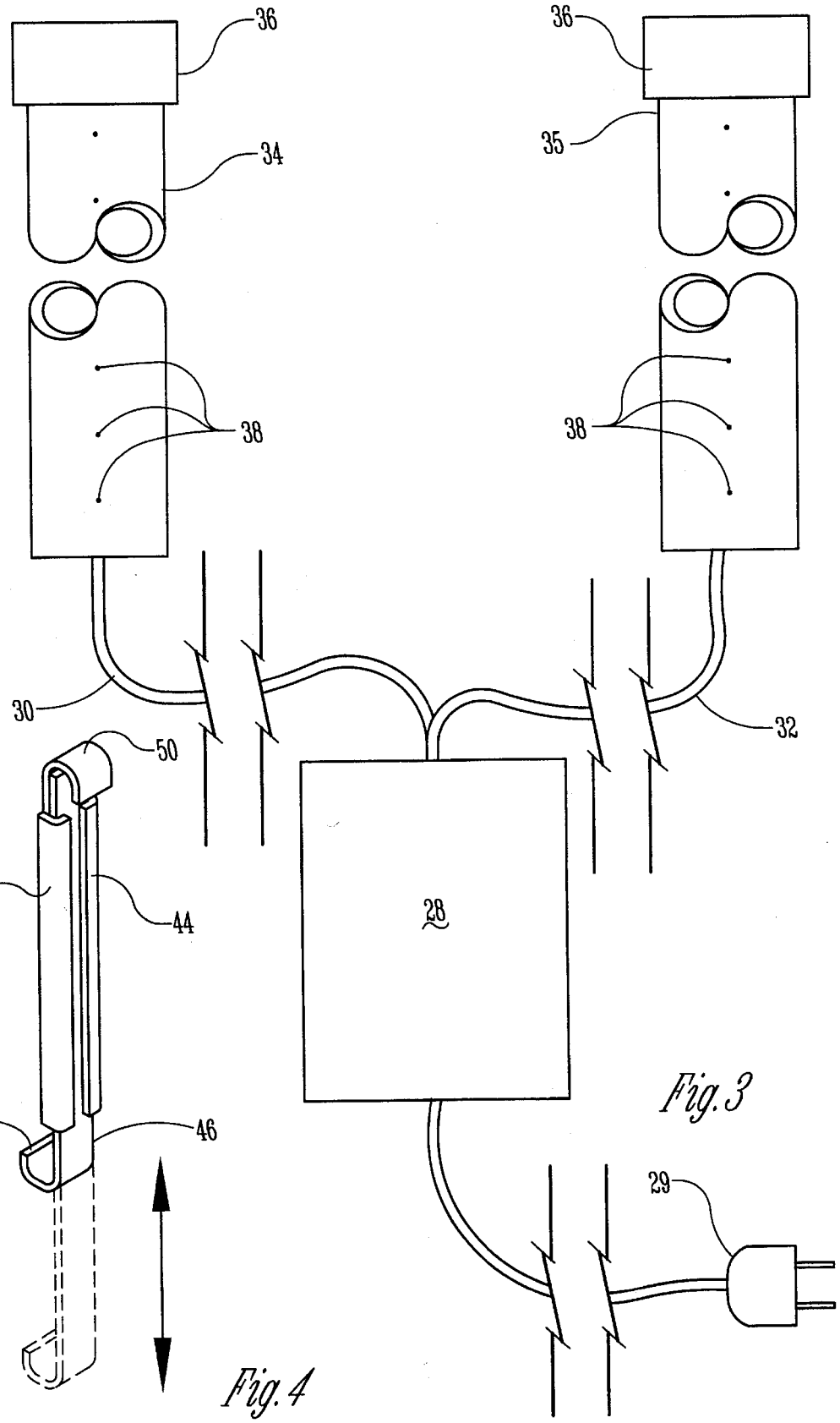
FIG. 3 is a simplified pictorial view showing the major components of the air circulation device of the present invention. For ease of illustration the conduits have been rotated ninety degrees from their normal positions so as to illustrate the perforations.
FIG. 4 is a perspective view of one embodiment of the mounting bracket of the present invention.

As best seen in FIGS. 2 and 3, the hose 30 is fluidly connected to the elongated conduit 34 and the hose 32 is fluidly connected to the elongated conduit 35. Preferably the length of the conduits 34, 35 corresponds to the length of the crib 10 from the headboard 12 to the footboard 14. The end of each conduit 34, 35 opposite its connection to the hoses 30, 32 is closed by a cap 36. The hoses 30 and 32 may be constructed of flexible tubing, but the conduits 34, 35 are preferably constructed of a rigid hollow tube. Because of its proximity to the infant and their proclivity to inserting items in their mouths, the conduits 34, 35 are preferably constructed of non-toxic material and have no burrs or protruding sharp edges. Generally, the length of the conduits 34, 35 should be sufficient to cover most areas of the crib where the infant might lay his or her head. A lightweight material also makes it less likely that the infant could be injured by the conduits 34, 35.

The conduits 34, 35 each include a series of spaced apart perforations 38 therein. The perforations 38 are preferably similar in size, aligned and evenly spaced along the length of the conduits 34, 35 so as to provide a uniform series of low volume, almost imperceptible, air flows. The conduits 34, 35 can rest on the top surface 18 of the mattress 16 or more preferably mount to the side rails 20, 22 or another part of the frame of the crib 10. The conduits 34, 35 are positioned adjacent the top surface 18 of the mattress 16 so that the perforations 38 are directed horizontally inwardly just above the top surface 18. The conduits 34, 35 should be positioned close to the top surface 18 so the air flow will be at the level of the infant's head.

It is contemplated that a single hose and conduit may be utilized on only one side of the crib 10. However, having conduits 34, 35 on each side of the crib 10 increases the likelihood that air flow will reach the infant's face regardless of the direction the infant is facing.

One or more telescoping mounting brackets 42 attach the conduits 34 and 35 to the side rails 20 and 22, respectively. As shown in FIG. 4, each bracket 42 includes a first portion 44 and a second portion 46. The second portion 46 telescopes into the first portion 44, so as to make the bracket 42 vertically extensible. The second portion 46 includes a hook 48 at its lower end for holding the conduit 35. The first portion 44 includes a similar hook 50 at its upper end with which the bracket 42 is mounted or hung from the side rail 22. The bracket can be further secured to one or more of the vertical bars 24 with any suitable fastening material, such as material having mating surfaces made up of hooks and loops.

With the second portion 46 of the bracket 42 in the position shown by solid lines in FIG. 4, the vertically adjustable side rail 22 has been lowered yet the conduit 35 remains in its proper position adjacent the top surface 18 of the crib 10. Proper conduit position can also be maintained when the side rail 22 is raised, even though the first portion 44 of the bracket 42 moves with the side rail 22 to which it is attached, by pushing the conduit 35 downwardly to extend the second portion 46 from the first portion 44 of the bracket 42. The second portion 46 of the bracket 42 will extend downward or telescope to the position shown by dotted lines in FIG. 4. Thus, the telescoping bracket 42 maintains the conduit position despite the side rail 22 being raised or lowered.

The present invention also provides a method for preventing the accumulation of carbon dioxide around an infant lying in the crib. The method includes providing one or more air conduits 34 and 35 having a plurality of perforations 38 therein, placing the air conduits in the crib 10 adjacent the top surface 18 of the mattress 16, connecting an air pump, blower or fan 28 to the air conduits, and pumping air through the perforations 38 of the conduits 34 and 35 so as to provide a plurality of air flows directed inwardly and across the top surface 18 of the mattress 16 to disperse carbon dioxide exhaled by the infant and ensure the continued normal breathing of the infant.

The above method is believed to lower the risk of the infant dying by SIDS. Furthermore, the device and method described above are also useful in dispersing various gases and/or odors present at the mattress level of the crib without creating drafts which could be harmful to the infant.

Whereas the invention has been shown and described in connection with the preferred embodiment thereof, it will be understood that modifications, substitutions, and additions may be made which are within the intended broad scope of the following claims. From the foregoing, it can be seen that the present invention accomplishes at least all of the stated objectives.

What is claimed is:

1. A device for generating controlled air flows at mattress level in a crib having a frame with opposing side rails and a mattress having a top surface, the device comprising:

an air blower;

an elongated conduit connected to the blower and positioned horizontally adjacent the top surface of the mattress, the conduit having a plurality of longitudinally spaced perforations therein so as to provide a plurality of air flows directed substantially horizontally across the top surface of the mattress;

the conduit being attached to one of the side rails of the frame;

a mounting bracket for attaching the conduit to the side rail;

the mounting bracket including telescoping first and second end portions such that the second end portion of the mounting bracket is vertically adjustable with respect to the side rail; and the first end portion being adapted to removably mount to the side rail and the second end portion being adapted to hold the conduit.

2. The device of claim 1 wherein the conduit has a first end operatively connected to the blower and a second end that is closed.

3. The device of claim 1 wherein a second conduit having a plurality of longitudinally spaced perforations therein is connected in parallel to the blower and the first conduit is mounted on one of the side rails and the second conduit is mounted on the opposing side rail.

4. The device of claim 1 wherein the first and second end portions are hook shaped.

5. The device of claim 1 wherein the perforations in the conduit are equally spaced apart along the length of the conduit.

6. The device of claim 1 wherein the conduit is a rigid tube.

7. A method for providing vertically adjustable substantially horizontal air flows across a top surface of a mattress in a crib having opposite sides, the method comprising:

adjustably mounting a first air conduit having a plurality of perforations therein adjacent the top surface of the mattress on one side of the crib for selective vertical movement with respect to said one side of the crib, the perforations being aimed in a substantially horizontal direction across the top surface of the mattress;

connecting an air supply means to the first air conduit, and pumping air through the perforations of the first air conduit so as to provide a plurality of air flows directed substantially horizontally across the-top surface of the mattress.

* * * * *